US005501334A

United States Patent [19]

Przytulla et al.

[11] Patent Number: 5,501,334

[45] Date of Patent: Mar. 26, 1996

[54] PALLET CONTAINER WITH COVER PLATE

[75] Inventors: Dietmar Przytulla, Kerpen; Märten Burgdorf, Swistal, both of Germany

[73] Assignee: Mauser-Werke GmbH, Brühl, Germany

[21] Appl. No.: 325,247

[22] PCT Filed: Apr. 21, 1994

[86] PCT No.: PCT/EP94/01245

§ 371 Date: Oct. 18, 1994

§ 102(e) Date: Oct. 18, 1994

[87] PCT Pub. No.: WO94/25367

PCT Pub. Date: Nov. 10, 1994

[30] Foreign Application Priority Data

Apr. 23, 1993 [DE] Germany ..... 9306177 U

[51] Int. Cl.[6] ..... B65D 19/00; B65D 90/20

[52] U.S. Cl. ..... 206/386; 206/509; 220/401

[58] Field of Search ..... 220/401, 1.5; 206/386, 206/599, 600, 509, 511

[56] References Cited

U.S. PATENT DOCUMENTS

| | | | |
|---|---|---|---|
| 4,909,387 | 3/1990 | Schutz | 206/386 |
| 4,947,988 | 8/1990 | Schutz | 206/386 |
| 5,366,090 | 11/1994 | Schutz | 206/599 |

FOREIGN PATENT DOCUMENTS

| | | | |
|---|---|---|---|
| 0498984 | 8/1992 | European Pat. Off. . | |
| 0515819 | 12/1992 | European Pat. Off. . | |
| 2947603 | 2/1981 | Germany . | |
| 2219788 | 12/1989 | United Kingdom | 220/401 |
| 9315966 | 8/1993 | WIPO . | |

*Primary Examiner*—Bryon P. Gehman
*Attorney, Agent, or Firm*—Henry M. Feiereisen

[57] ABSTRACT

The invention refers to a pallet container (10) for storage and transport of liquid contents with a thin-walled inner container (12) of thermoplastic material, with a support jacket (15) of wire cage bars or pipe bars which tightly enclose the inner container (12) and with a bottom pallet (16) suitable for application with a forklift and fixedly secured to the support jacket (14), wherein the inner container (12) is provided in the top plate (18) with a charging opening (20) and with a discharge valve (22) near the bottom. In order to improve the stacking capability and to increase the stackability, the top plate (18) of the inner container (12) is covered from above by a cover plate (26) which includes a central opening (28) for access to the upper charging opening (20) and is fixedly secured about its perimeter with the upper edge of the support jacket (14). The upper edge of the support jacket (14) is formed by the uppermost circumferential cage bar (24) or pipe bar which is covered from above in horizontal or radial direction by the cover plate (26) and from outside in vertical or axial direction by a subsequently arranged flange rim (34) which projects downwardly essentially at a right angle from the cover plate (26).

24 Claims, 5 Drawing Sheets

PALLET CONTAINER WITH COVER PLATE

Figure 1:
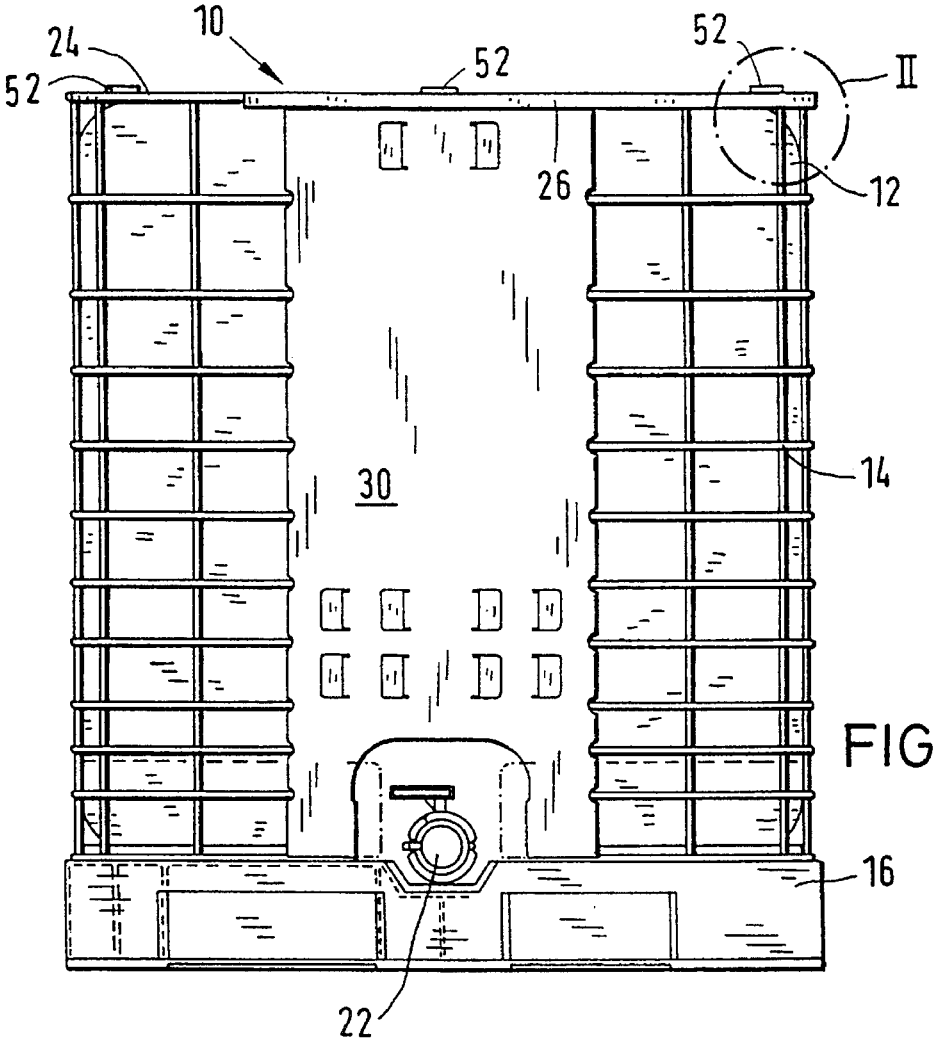

The invention refers to a pallet container for storage and transport of liquid contents according to the features in the preamble of claim 1.

Such a pallet container is known e.g. from U.S. Pat. No. Des. 297,619. When stacking such pallet containers with a support jacket in form of a wire cage in so-called lightweight construction—without massive angle frame supports and without stable corner posts—the stacked bottom pallet, e.g. a wooden pallet with three single stringers can result in an uneven load distribution and load introduction into the lower cage jacket. Also, the narrow upper rim of the support jacket of the cage complicates an exact placement of a filled heavy pallet container by means of a forklift truck and makes it almost impossible to displace and straighten a stacked pallet container along the rim of the lower support jacket.

It is an object of the present invention to provide a pallet container with increased stability and improved stacking capability.

This object is attained in accordance with the present invention in a pallet container of lightweight construction of the type having a support jacket made of crossed pipe bars or cage bars without massive corner support by providing a cover plate which covers the top plate of the inner container from above and includes a central opening for access to the upper charging opening, wherein the cover plate is fixedly secured about its circumference to the rim of the support jacket and wherein the upper rim of the support jacket is formed by the uppermost horizontal circumferential cage bar or pipe bar, with the cage bar or pipe bar being overlapped from above in horizontal or radial direction by the cover plate and from outside in vertical or axial direction by a flange rim which projects downwardly essentially at a right angle.

The provision of the upper cover plate upon the pallet container advantageously creates during stacking of like pallet containers for the bottom pallet of a stacked pallet container a large flat standing area in upward direction and an even load distribution and thus load introduction in downward direction into the support jacket of the subjacent pallet container. Also, the forklift operator can now in a considerably more simple manner stack and precisely align, possibly through shifting, the pallet containers.

Moreover, the upper rim of the support jacket is better protected during transport against spotwise loads which result in possible lateral buckling. The overall stability of the lightweight pallet container is improved.

Since the cover plate bears throughout upon the uppermost horizontal circumferential cage bar or pipe bar of the support jacket, and since the uppermost cage bar is received in a respective recess or circumferential groove of the underside of the cover plate in the area of the flange rim which is arranged there, the upper rim of the support jacket is securely fixed in the plane of the cover plate and a buckling or giving-way in horizontal or radial direction is prevented.

In accordance with the invention, the pallet container has a particular overall stability by extending at each side of the support jacket or/and in its corner areas at least one vertical cage bar or pipe bar upwardly beyond the uppermost horizontal circumferential cage bar, passing it through a respective bore in the cover plate and securing it from above to the cover plate.

Suitably, the vertical cage bars which are upwardly extended and traverse the bores in the cover plate are provided with a screw thread, and the cover plate is fixedly but easily detachably screwed and mounted from above to the extended cage bars by counternuts or flange nuts.

This permits a simple and cost-efficient assembly of the individual components of a pallet container, on the one hand, and a simple detachment of the cover plate in such a pallet container e.g. when replacing or renewing a thin-walled inner plastic container while allowing repeated use of the remaining pallet components, on the other hand.

Moreover, such a pallet container can easily be disassembled for a complete material recycling when being disposed of and taken apart into its individual components since all connections are designed for easy separation.

In accordance with an advantageous embodiment of the invention, at least some of the upwardly extended cage bars which pass through the cover plate and are secured from above are also suitably extended downwards to traverse respective bores in the bottom pallet and secured from below with the bottom pallet, preferably through screwing. This particular variation advantageously accomplishes with only comparably few screwed connections a secure attachment of the individual pallet components relative to each other, a secure enclosure of the inner container and a high stability of the overall construction.

Further advantages are as follows: the upper cover plate results in a significant improvement of the internal pressure resistance (test pressure 1 bar) and the cover plate provides a safe support with even load distribution for a stacked second (and third) pallet container. In closed version, the cover plate serves also as cover and UV protection for the inner container during external storage of the pallet container.

In order to save material and weight, the cover plate is provided in accordance with another lightweight embodiment with several further bores or openings in symmetric arrangement about the central opening for the charging pipe (window version). These openings may also be made at closed version at a thin material width of e.g. 2 mm.

Figure 2:
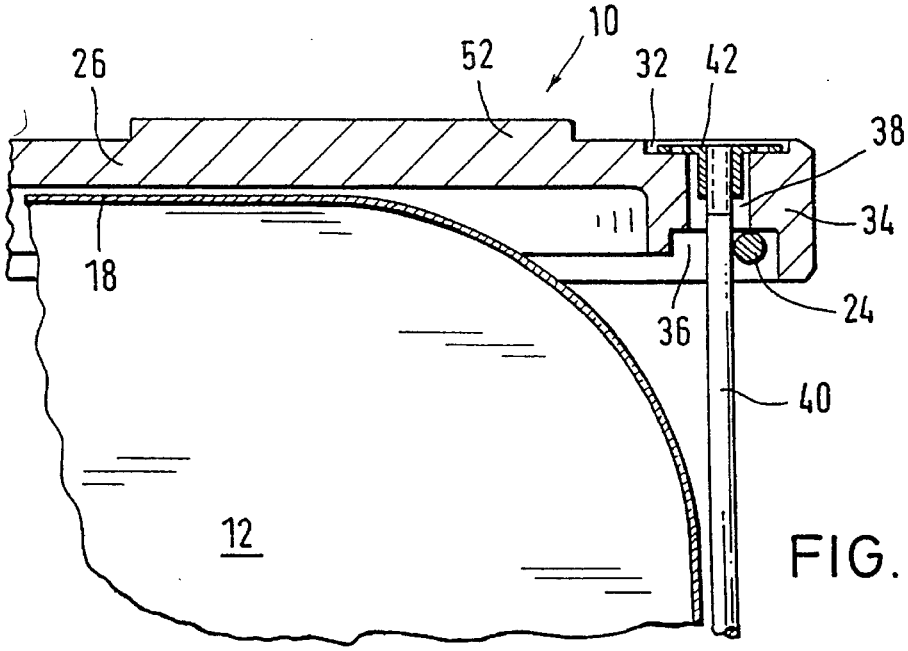
Figure 3:
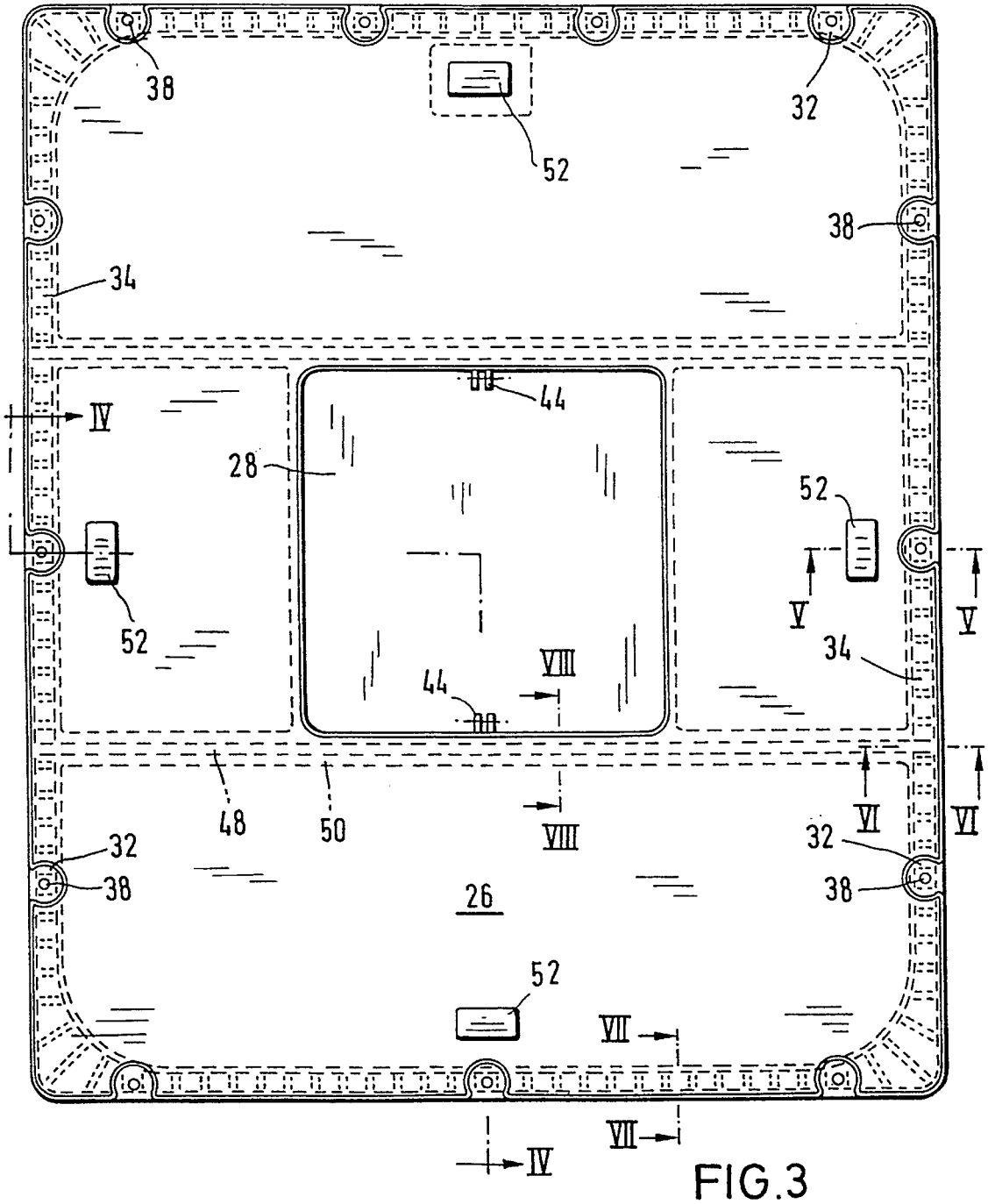
Figure 4:
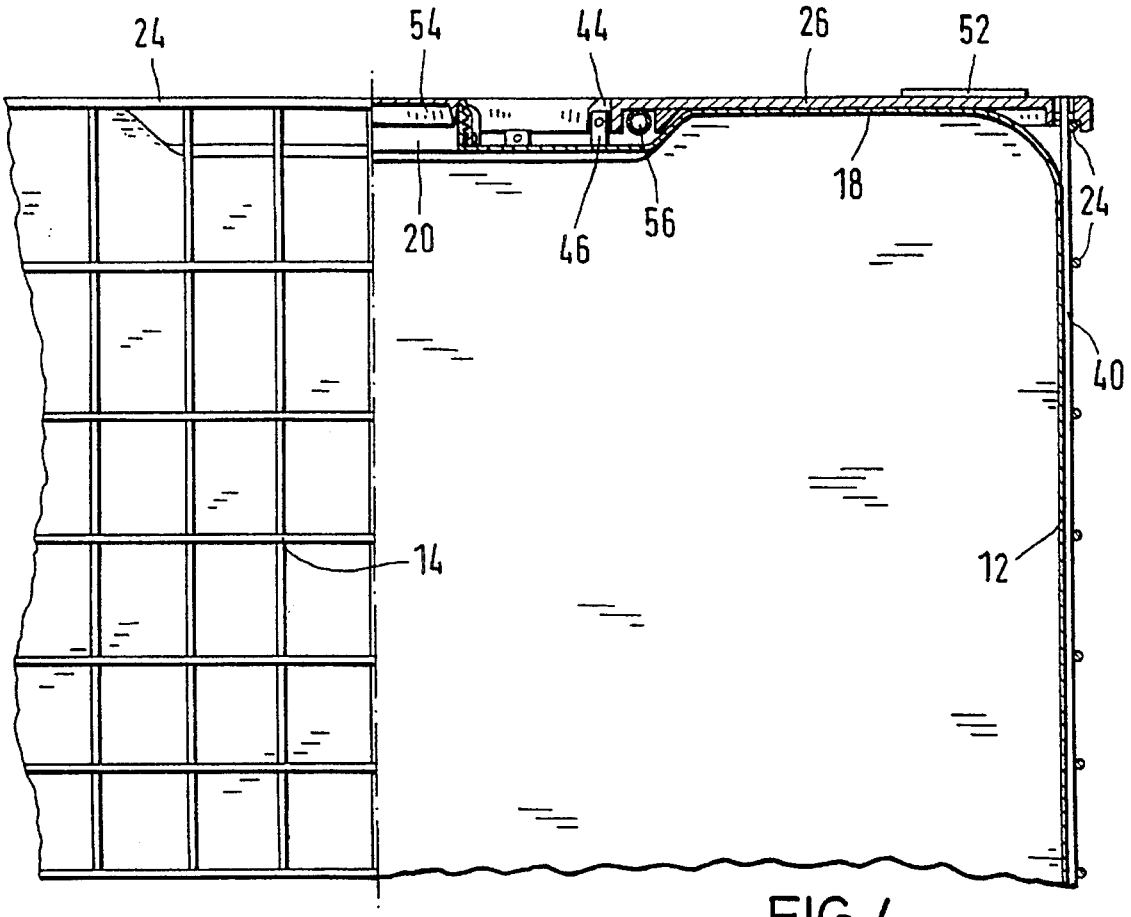
Figure 8A:
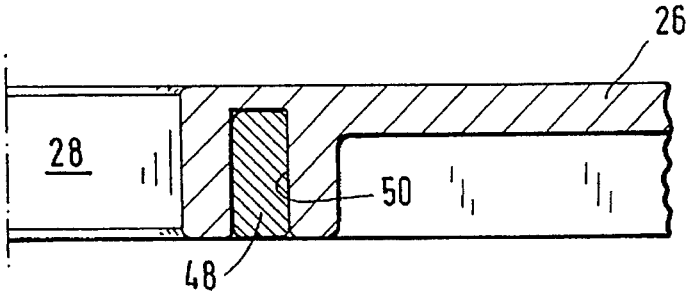
Figure 8B:
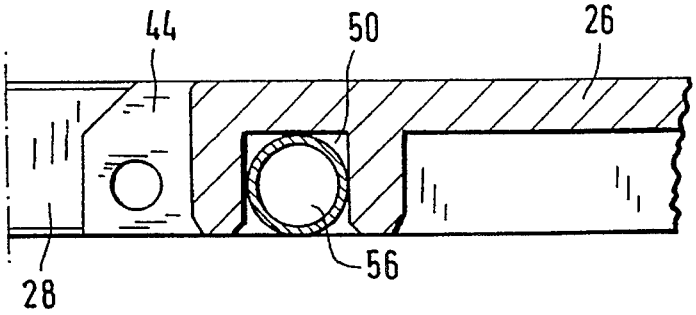
Figure 9:
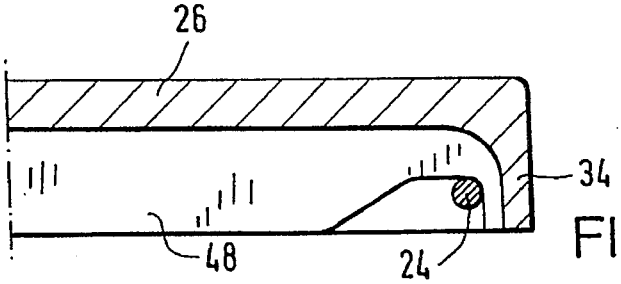
Figure 10:
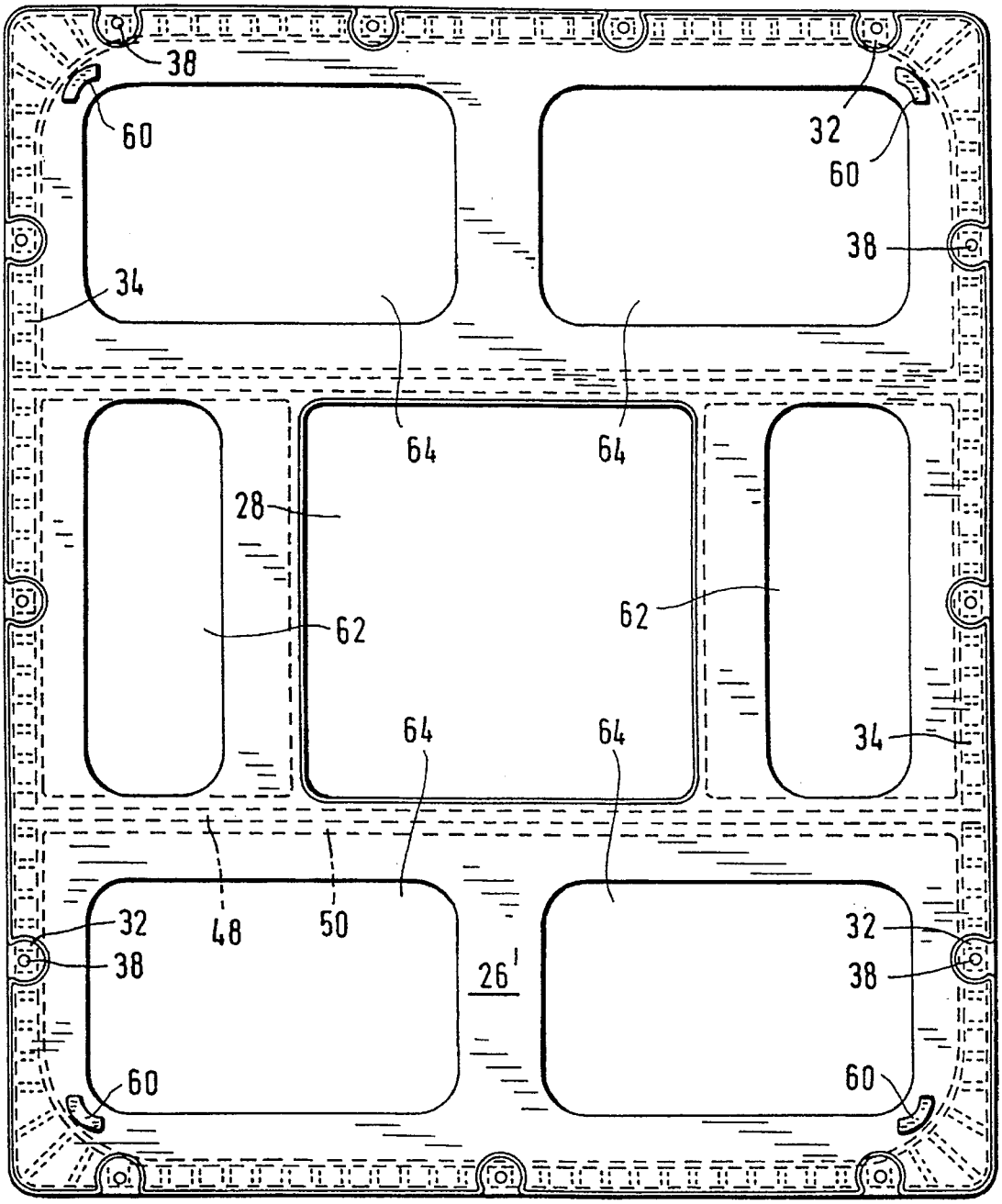

The invention is explained and described in greater detail hereinafter with reference to embodiments which are illustrated in the drawings. In the drawings:

FIG. 1 shows a side view of a pallet container according to the invention,

FIG. 2 shows the right upper corner area II of the pallet container of FIG. 1, on an enlarged scale, FIG. 3 shows a top view of the upper cover plate of the pallet container, FIG. 4 shows a partial section along the line IV—IV in FIG. 3, FIGS. 5 to 9 show different partial sectional views through the upper cover plate according to the invention, and FIG. 10 a further advantageous embodiment of the cover plate according to the invention.

In FIG. 1, reference numeral 10 designates a pallet container which includes a thin-walled blow molded inner container 12 of thermoplastic material and a support jacket 14 which tightly encloses the inner container 12 and is made of galvanized wire mesh cage bars or pipe bars. The lower end of the support jacket 14 is securely fixed to a bottom pallet 16 which is suitable for application by a forklift. The bottom pallet 16 is made preferably of recycled plastic material. Compared to metal pipe pallets or conventional wooden pallets, such a plastic bottom pallet has improved moisture resistance and acid resistance, on the one hand, and is also free of corrosion problems, on the other hand.

The support jacket 14 of the pallet container 10, illustrated in FIG. 1, includes a single board of crossing cage bars which are angled by 90° at the four corner areas, with a connecting line (e.g. weld) being located vertically above the bottom-proximate discharge valve 22. The connection of the wire cage support jacket is realized in the case at hand by a clinch sheet 30 which covers at least two vertical cage bars at each side of the connecting line and is provided in addition at its outer edges and within the sheet with punched-out tongues which are bent or clinched about the covered vertical cage bars.

The inner container 12 includes an upper charging opening 20 (FIG. 4), which is recessed within the top plate 18, and a discharge valve 22 near the bottom for removal of liquid contents. Placed onto the uppermost horizontal circumferential cage bar 24 of the support jacket 14 is a flat cover plate 26, preferably also of recycled plastic material, which covers the inner container 12 from above and has a central respectively recessed opening 28 for access to the upper charging opening 20, and which is fixedly but easily removably secured about its circumference to the upper rim of the support jacket 14.

As best seen in FIG. 2, the uppermost horizontal circumferential cage bar 24 forming the upper edge of the support jacket 10 is covered in horizontal or radial direction by the upper cover plate 26 and in vertical and axial direction from outside by a flange rim 34 which projects downwardly essentially at a right angle from the cover plate 26, with the underside of the cover plate 26 which is placed upon the uppermost horizontal circumferential cage bar 24 being provided in the outer flange rim 34 with a corresponding recess or circumferential groove 36 for receiving the uppermost cage bar 24.

In accordance with a further important feature of the invention, at least one vertical cage bar 40 is upwardly extended by about 20 mm beyond the uppermost horizontal circumferential cage bar 24 at each side of the support jacket 14 or/and in the respective corner areas thereof, traverses a respective bore 38 in the cover plate 26 or the flange rim 34 and is mounted from above to the cover plate 26. For example, button sleeves may be snugly fitted or disk-shaped abutments may be welded thereon. For creating an easily loosenable and yet tight connection of the cover plate 26 and the support jacket 14, the preferred embodiment of the invention includes that the upwardly extended cage bars 40 which pass through bores 38 or openings are provided at their upper end with a screw thread, and the cover plate 26 is securely screwed to the support jacket from above by means of nuts 42. The nuts 42 are preferably designed in form of flange nuts with flat head and countersunk in a respective depression/counterbore 32 in the upper surface of the cover plate 26.

FIG. 3 illustrates a plan view of the cover plate 26 which includes at a central location thereof a respective rectangular opening 28 for access to the subjacent upper charging opening of the inner container. Arranged opposite to each other in the opening 28 are two forked connecting pieces 44 which project inwardly and are interlocked with two complementary upright connecting pieces 46 formed laterally on the top plate 18 next to the charging opening 20 of the inner container 12.

FIG. 3 shows in broken lines the arrangement of two parallel support bars 48 laterally next to the charging opening 20 of the inner container 12, that is laterally next to the opening 28, for support of the cover plate 26 in the central area. The support bars 48 are attached at their outer ends to the uppermost horizontal circumferential cage bar 24. Suitably, the underside of the cover plate 26 is formed with a respective groove 50 for receiving the support bar 48 in a countersunk manner.

Also indicated only by way of broken lines are stiffening ribs 58 formed on the underside of the flange rim 34 in the groove 36 which extends there. Preferably three (up to five) bores 38 are provided on the top surface of the cover plate 26 along the flange rim at each outer edge of the cover plate for passage of the extended cage bars, together with a corresponding depression/counterbore 32 for the flange nut being screwed thereto.

Only four bores 38 for passage of the cage bars are provided on the (here upper) narrow outer edge upon which also the bottom-proximate discharge valve 22 of the inner container 12 is located. A pallet container designed in this manner is characterized by a superior drop resistance during drop tests, especially at drops along the edges.

As further shown in FIG. 3, rectangular stacking blocks 52 or projections protrude upwardly from the upper surface of the cover plate 26 at a central location along the outer edge for stacking like pallet containers in aligned manner, with each stacked pallet container being provided on the underside or bottom area of the bottom pallet 16 with correspondingly arranged and shaped depressions or recesses for engagement by the stacking blocks 52. The stacking blocks advantageously prevent e.g. a shifting of especially empty pallet containers stacked on the loading area of a truck or on the forks of a forklift, during a bumpy transport.

FIG. 4 shows an enlarged partial section of the pallet container 10. The central charging opening 20 is recessed in the top plate 18 of the inner container 12 and closed by a screw cap 54. Arranged laterally next thereto is the form-fitting connection between the inner container 12 and the cover plate 26 via the interlocking and pinned connecting pieces 44, 46 of the top bottom 18 and the inside of the opening 28 in the cover plate 26. Arranged directly next thereto below the cover plate 26 is the transversely extending support bar, formed here as support pipe 56, upon which the cover plate 26 is placed. An upright stacking block 52 is arranged at the marginal area on the upper surface of the cover plate 26. At its perimeter, the cover plate 26 rests with its flange rim 34 about the uppermost horizontal cage bar 24 and is fixedly but easily removably screwed to the extended vertical cage bar 40 passed therethrough.

Figure 5:
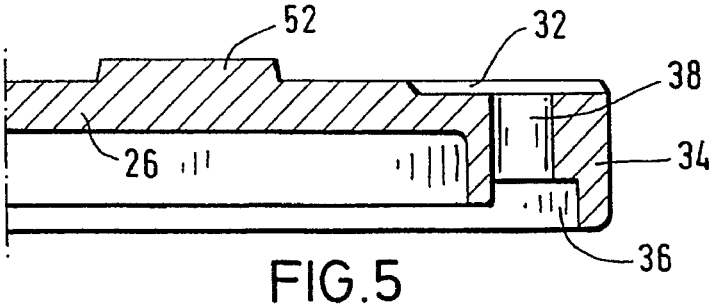
Figure 7:
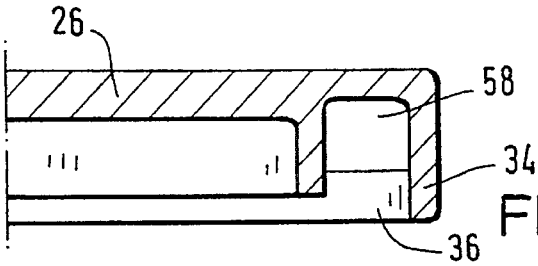

FIG. 5 is a partial section along the line V—V in FIG. 3 through the marginal area or flange rim 34 of the cover plate 26 in the area of one bore 38 for passage of an extended vertical cage bar 40. The thickness of the cover plate 26 is generally about 10 mm and in the area of the flange rim 34 about 30 mm. The flange rim 34 is of massive design about the bore 38 while being hollow 34 from below in the sections between the bores 38 and, as shown in FIG. 7 along line VII—VII, provided with a number of evenly spaced stiffening ribs 58 for saving material.

The construction of the pallet container according to the invention with cover plate placed thereon results in a significant improvement of the stability with regard to prevailing internal pressure (static internal pressure test at 1 bar over 5 minutes). At rising internal pressure, the inner container tends to assume a balloon-like configuration with considerable arching of the top plate; this may lead to instabilities and problem during transport (drop of container) when e.g. stacking containers. Also this drawback is eliminated by the increased overall stability of the pallet container according to the invention.

Figure 6:
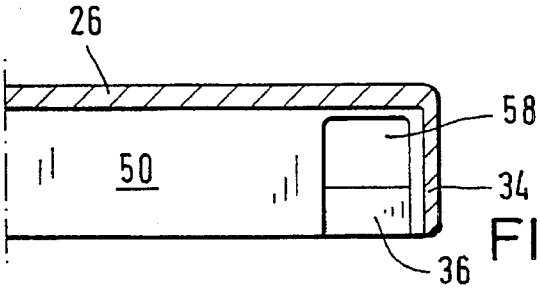

FIG. 6 shows a partial section along line VI—VI in FIG. 3 through the flange rim 34. In this area, the groove 50 for the support bar 48 and the support pipe 46, respectively, extends to or connects with the lower groove 36 at a right angle along the flange rim 34. FIG. 9 clearly shows the manner of forming the support bar 48, which is inserted in the groove 50, at the outside to a hook and placement thereof over the uppermost horizontal circumferential cage bar 24. After screwing the cover plate 26, both support bars 48 are immovably secured.

FIG. 8*a* is a partial section along line VIII—VIII in FIG. 3 through the outer edge of the inner opening 28 (for access to the upper charging opening 20) to clearly show the lateral securement of the flat iron support bar 48 which is inserted in the groove 50.

FIG. 8*b* shows a slightly modified embodiment in which the groove 50 is formed slightly wider for insertion of a support bar in form of a hollow steel support pipe 56. On the left side, the connecting piece 44 is further shown via which the interlocking connection with the top plate of the inner container by means of the connecting pieces 46 formed there is obtained.

A further advantageous lightweight embodiment of the cover plate according to the invention is characterized by forming laterally next to the central opening 28 for the charging opening of the inner container and in the corner areas of the cover plate 26' further openings or bores 62, 64 in symmetric arrangement (window version). In this manner, use of plastic material during production and the weight of the plate itself can be reduced, without loss of stability and stiffness of the cover plate.

A reduction of material and weight can, however, already be attained when forming the additional openings not in form of complete bores but at a significantly smaller width relative to the remaining plate strength (thickness). The average plate strength may be e.g. 8–10 mm and the areas in the opening zones are only 4 mm or even only 1–2 mm thick (thin film version).

The upper cover plate thus represents a stable upper end piece for the cage frame.

Such a circumferential end piece may also be realized in accordance with a modified embodiment e.g. through a steel pipe, an angle iron or a section steel rail formed of e.g. rectangular cross section or in form of a double-T beam. All these components create an even load distribution and should be considered as equivalent solution within the scope of the invention, as long as the feature of cage bars passing through bores and screwed from above is used.

LIST OF REFERENCE NUMERALS

10 Pallet container
12 Inner plastic container
14 Support jacket
16 Bottom pallet
18 Top plate (12)
20 Upper charging opening (12)
22 Discharge valve (12)
24 Uppermost horizontal cage bar
26 Cover plate
28 Opening (26)
30 Clinch sheet
32 Depression/counterbore (42)
34 Flange rim (26)
36 Groove (26)
38 Bore (26)
40 Vertical cage bar
42 Nut
44 Connecting pieces (26)
46 Connecting pieces (12)
48 Support bar
50 Groove (26/48)
52 Stacking block (26)
54 Screw cap (20)
56 Support pipe
58 Stiffening rib
60 Stacking block (26')
62 Lateral bore/thin spot
64 Corner area bore/thin spot (=opening/window)

We claim:

1. Pallet container (10) for storage and transport of liquid contents, comprising a thin-walled inner container (12) made of thermoplastic material and having a top plate (18) formed with a charging opening (20) and a discharge valve (22) near a lower end thereof; a support jacket (14) of bars which tightly enclose the inner container (12); and a bottom pallet (16) suitable for application with a forklift and fixedly secured to the support jacket (14), wherein the top plate (18) of the inner container (12) is covered from above by a cover plate (26) of thermoplastic material which includes a central opening (28) for access to the charging opening (20) and is fixedly secured about its perimeter with an upper rim of the support jacket (14), said support jacket (14) having an upper edge formed by the uppermost circumferential bar (24) which is covered from above in horizontal direction by the cover plate (26) and covered from outside in vertical direction by a subsequently arranged flange rim (34) which projects downwardly substantially at a right angle from the cover plate (26), wherein on each side of the support jacket (14) at least one vertical bar (40) of the support jacket (14) is upwardly extended beyond the uppermost horizontal circumferential bar (24), passed through a respective bore (38) in the cover plate (26) and secured from above to the cover plate (26).

2. Pallet container according to claim 1 wherein the cover plate(26) bears upon the uppermost horizontal circumferential bar (24) of the support jacket (14), and the underside of the cover plate (26) in the flange rim (34) is provided with a corresponding opening or circumferential groove (36) for receiving the uppermost bar (24).

3. Pallet container according to claim 1 wherein the vertical, upwardly extended bars (40) which traverse the bores (38) in the cover plate (26) are provided with a screw thread, and the cover plate (26) is fixedly but easily removably screwed and mounted to the extended bars (40) by means of counternuts (42) screwed from above.

4. Pallet container according to claim 1 wherein at least some of the upwardly extended vertical bars (40) which pass through the cover plate (26) and are secured from above are suitably extended downwards, passed through respective bores in the bottom pallet (16) and secured from below to the bottom pallet (16).

5. Pallet container according to claim 1 wherein the thin-walled inner plastic container (12) with its top plate (18) is connected in proximity next to the charging opening (20) in form-fitting manner with the cover plate (26).

6. Pallet container according to claim 5 wherein the inner container (12) is provided in proximity laterally next to its charging opening (20) with at least two oppositely arranged connecting pieces (46) which are connected with two complementary connecting pieces (44) formed on the cover plate (26).

7. Pallet container according to claim 1 wherein the cover plate (26) is supported by parallel support bars (48) which are arranged at least laterally next to the charging opening (20).

8. Pallet container according to claim 7 wherein the support bars (48) extend in a groove (50) formed on the underside of the cover plate (26) and are respectively secured with their both ends to the uppermost horizontal circumferential bar (24) of the support jacket (14).

9. Pallet container according to claim 7 wherein each of the support bars (48) is made in form of a flat iron placed on edge, with both its ends being flattened and provided with a downwardly projecting hook by which the uppermost horizontal circumferential bar (24) is grasped from above.

10. Pallet container according to claim 7 wherein each of the support bars (48) is made in the form of a metal pipe, with both its outer ends being flattened and of forked configuration for simultaneously engaging from above and gripping from below the uppermost horizontal circumferential bar (24).

11. Pallet container according to claim 1 wherein the cover plate (26) is provided on its surface preferably in a central area along the sides thereof with small projections (52) for engagement in complementary recesses of the bottom pallet (16) of a further stacked pallet container (10).

12. Pallet container according to claim 1 wherein the cover plate includes openings (62, 64) in symmetric arrangement laterally next to the central opening (28) and in corner areas of the cover plate (26') for saving material and weight.

13. A pallet container for storage and transport of liquid contents, comprising:

a thermoplastic inner container having a top plate formed with a charging opening;

a support jacket in form of a plurality of horizontal and vertical bars to define a cage that encloses the inner container, said support jacket having an upper edge formed by an uppermost horizontal bar;

a bottom pallet secured to the support jacket; and a thermoplastic cover plate positioned over the top plate and including a central opening for access to the charging opening and formed with a flange rim extending downwardly from the cover plate, said cover plate being securely fixed about its perimeter to the support jacket such that the uppermost horizontal bar is covered by the cover plate from above and by the flange rim laterally from outside, wherein each side of the support jacket has at least one vertical said bar that is upwardly extended beyond the uppermost horizontal bar and passed through a respective bore in the cover plate for securement from above to the cover plate.

14. The pallet container of claim 13 wherein the cover plate bears upon the uppermost horizontal bar and is formed with an inner circumferential groove for receiving the uppermost bar.

15. The pallet container of claim 13 wherein each said vertical bar is formed with a screw thread for detachable securement of the cover plate via a counternut.

16. The pallet container of claim 13 wherein at least some of the vertical bars extend through respective bores in the bottom pallet for securement from below.

17. The pallet container of claim 13 wherein the top plate of the inner container and the cover plate are in interlocking relationship in proximity of the charging opening.

18. The pallet container of claim 17 wherein the top plate is provided with at least two opposing pins for engagement in complementary bores of the cover plate.

19. The pallet container of claim 13, further comprising a support bar extending next to the charging opening for propping the cover plate.

20. The pallet container of claim 19 wherein the cover plate is formed on its underside with a groove for receiving the support bar, said support bar having opposite axial ends secured to the uppermost horizontal bar.

21. The pallet container of claim 19 wherein the support bar is made in the form of a flat iron placed on edge, with both axial ends being flattened and provided with a downwardly projecting hook for grasping the uppermost horizontal bar from above.

22. The pallet container of claim 19 wherein the support bar is made in the form of a metal pipe, with both axial ends being flattened and of forked configuration for simultaneously engaging from above and gripping from below the uppermost horizontal bar.

23. The pallet container of claim 13 wherein the cover plate is formed with a projection for engagement in a complementary recess in a bottom pallet of a further stacked pallet container.

24. The pallet container of claim 13 wherein the cover plate is formed with a symmetric arrangement of openings in proximity of the central opening and in corner areas thereof.

* * * * *